US005549402A

United States Patent [19]

Yamaguchi

[11] Patent Number: 5,549,402

[45] Date of Patent: Aug. 27, 1996

[54] PRINTING APPARATUS

[75] Inventor: Naoto Yamaguchi, Nagano, Japan

[73] Assignee: Seiko Epson Corporation, Tokyo, Japan

[21] Appl. No.: 201,865

[22] Filed: Feb. 24, 1994

[30] Foreign Application Priority Data

Mar. 1, 1993 [JP] Japan ..... 5-040056
Dec. 28, 1993 [JP] Japan ..... 5-350662

[51] Int. Cl.[6] ..... B41J 13/02

[52] U.S. Cl. ..... 400/708; 400/636; 226/45

[58] Field of Search ..... 400/625, 636, 400/636.1, 636.2, 703, 708; 271/227, 258, 261; 226/24, 42, 45

[56] References Cited

FOREIGN PATENT DOCUMENTS 2558961 7/1976 Germany .
3335078 3/1984 Germany .
51-78245 7/1976 Japan .
2235809 3/1991 United Kingdom .

*Primary Examiner*—David A. Wiecking
*Attorney, Agent, or Firm*—Stroock & Stroock & Lavan

[57] ABSTRACT

A follower roller 100 adapted to be rotated while coming in contact with a recording medium 120 is rotatably mounted on a driving roller shaft 114 of a driving roller 113, i.e., one of an opposing pair of driving rollers 111 and 113, and a rotation detector 115 for detecting the rotation of the follower roller 100 is disposed in the vicinity of the driving roller 113. A controller detects a malfunction of paper clogging by comparing the detection signal outputted from the rotation detector 115 with the driving signal outputted from the controller for rotationally driving a paper feeding motor. The follower roller 100 includes a ring-shaped magnet 121 including a plurality of magnet segments which are alternately magnetized in such a manner that adjacent magnet segments exhibit different magnetic poles with a radially extending boundary line as a boundary therebetween.

9 Claims, 10 Drawing Sheets

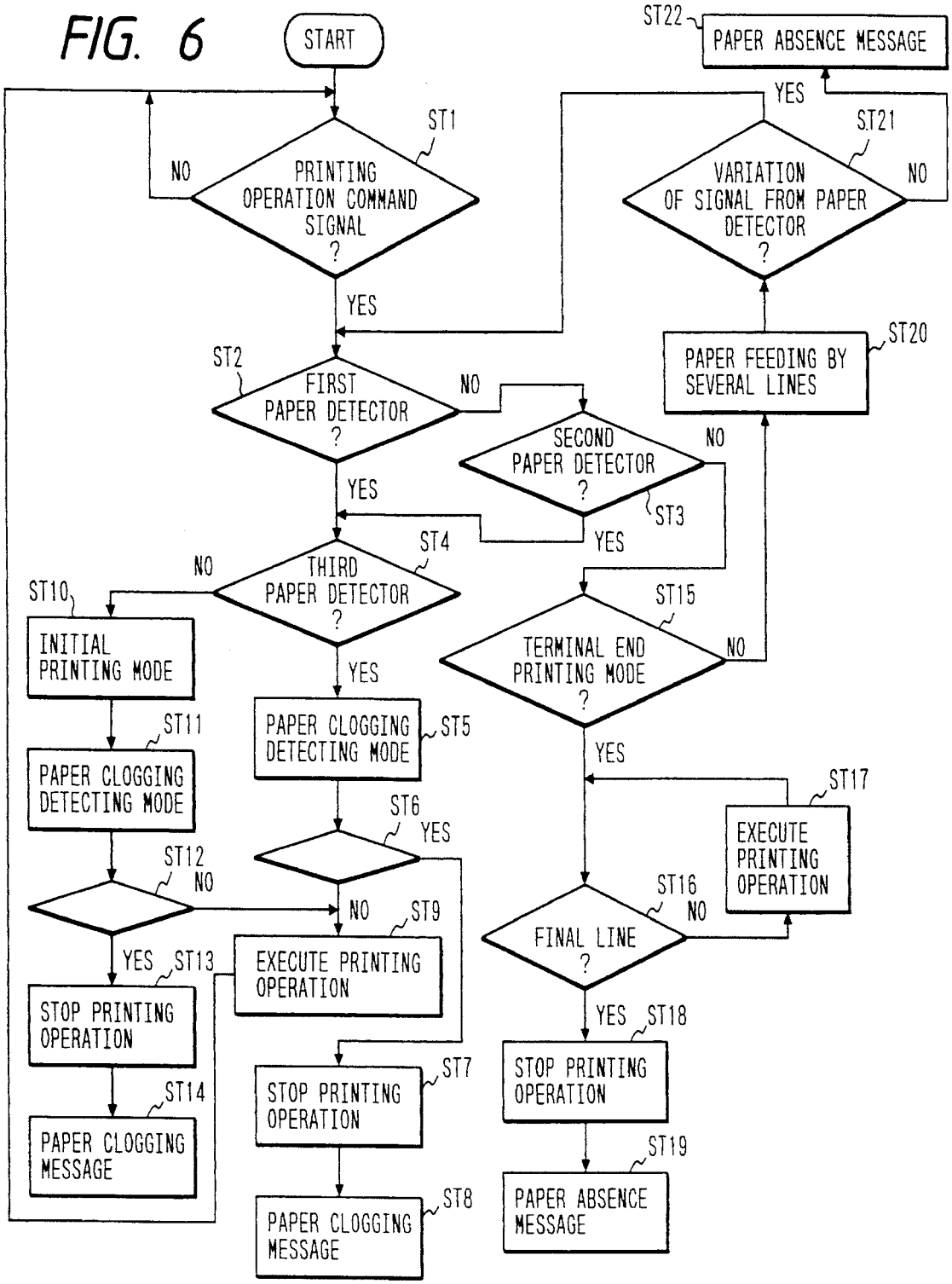
ST6 : DETECT A MULFUNCTION OF PAPER CLOGGING BY COMPARING ROTATION DETECTING SIGNAL WITH MOTOR DRIVING SIGNAL
ST12: DETECT A MALFUNCTION OF PAPER CLOGGING DEPENDING ON THE PRESENCE OR ABSENCE OF SIGNAL OUTPUT FROM THIRD PAPER DETECTOR ON COMPLETION OF INITIAL PRINTING MODE BASED ON A VALUE DERIVED FROM COUNTING THE NUMBER OF MOTOR DRIVING SIGNALS

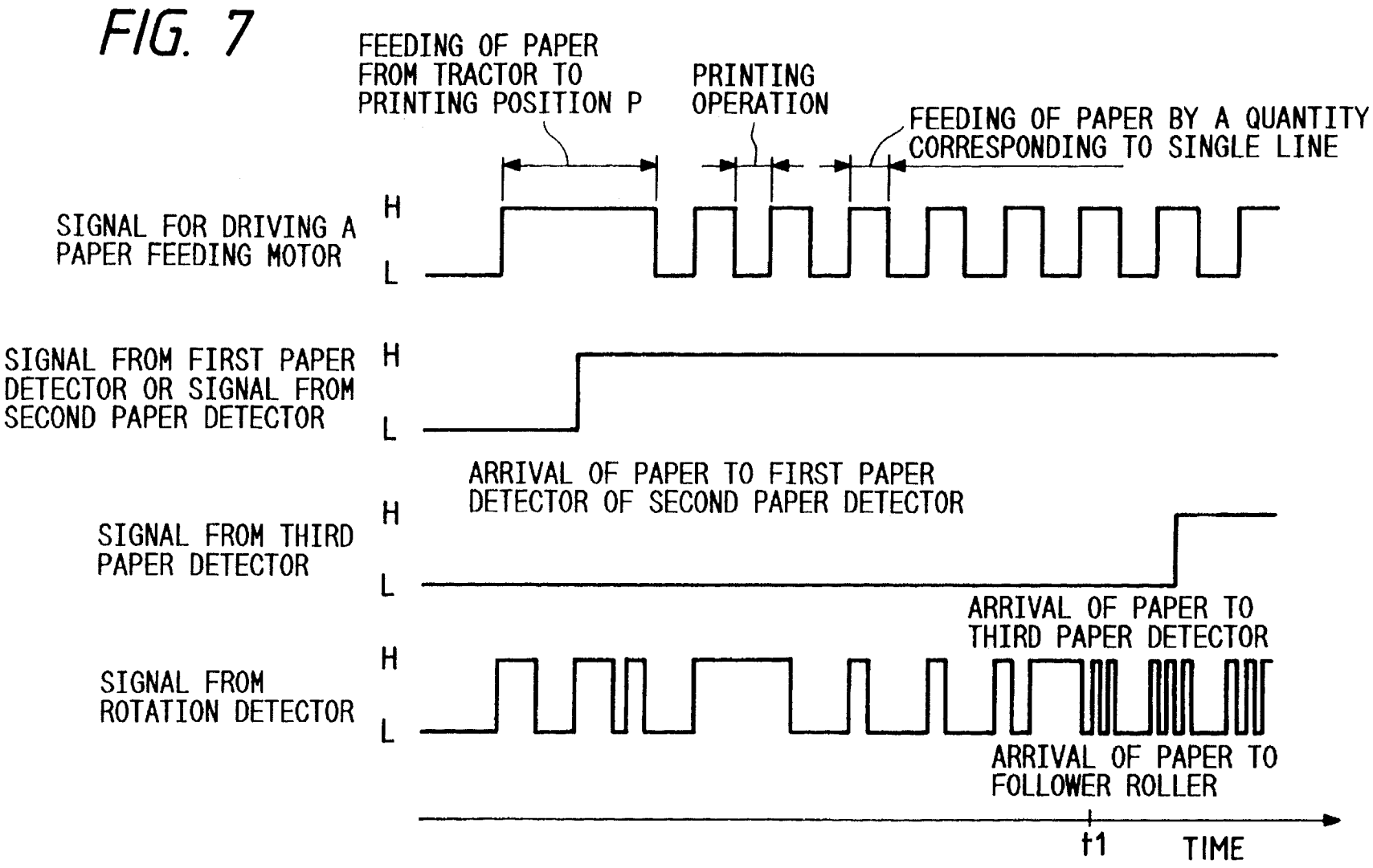
FIG. 7
SIGNAL FOR DRIVING A PAPER FEEDING MOTOR
SIGNAL FROM FIRST PAPER DETECTOR OR SIGNAL FROM SECOND PAPER DETECTOR
SIGNAL FROM THIRD PAPER DETECTOR
SIGNAL FROM ROTATION DETECTOR
H
L
FEEDING OF PAPER FROM TRACTOR TO PRINTING POSITION P
PRINTING OPERATION
FEEDING OF PAPER BY A QUANTITY CORRESPONDING TO SINGLE LINE
ARRIVAL OF PAPER TO FIRST PAPER DETECTOR OF SECOND PAPER DETECTOR
ARRIVAL OF PAPER TO THIRD PAPER DETECTOR
ARRIVAL OF PAPER TO FOLLOWER ROLLER
t1
TIME ST6 : DETECT A MULFUNCTION OF PAPER CLOGGING BY COMPARING ROTATION DETECTING SIGNAL WITH MOTOR DRIVING SIGNAL ST12' : DETECT A MALFUNCTION OF PAPER CLOGGING DEPENDING ON THE PRESENCE OR ABSENCE OF SIGNAL OUTPUT FROM ROTATION DETECTOR ON COMPLETION OF INITIAL PRINTING MODE BASED ON A VALUE DERIVED FROM COUNTING OF THE NUMBER OF MOTOR DRIVING SIGNALS

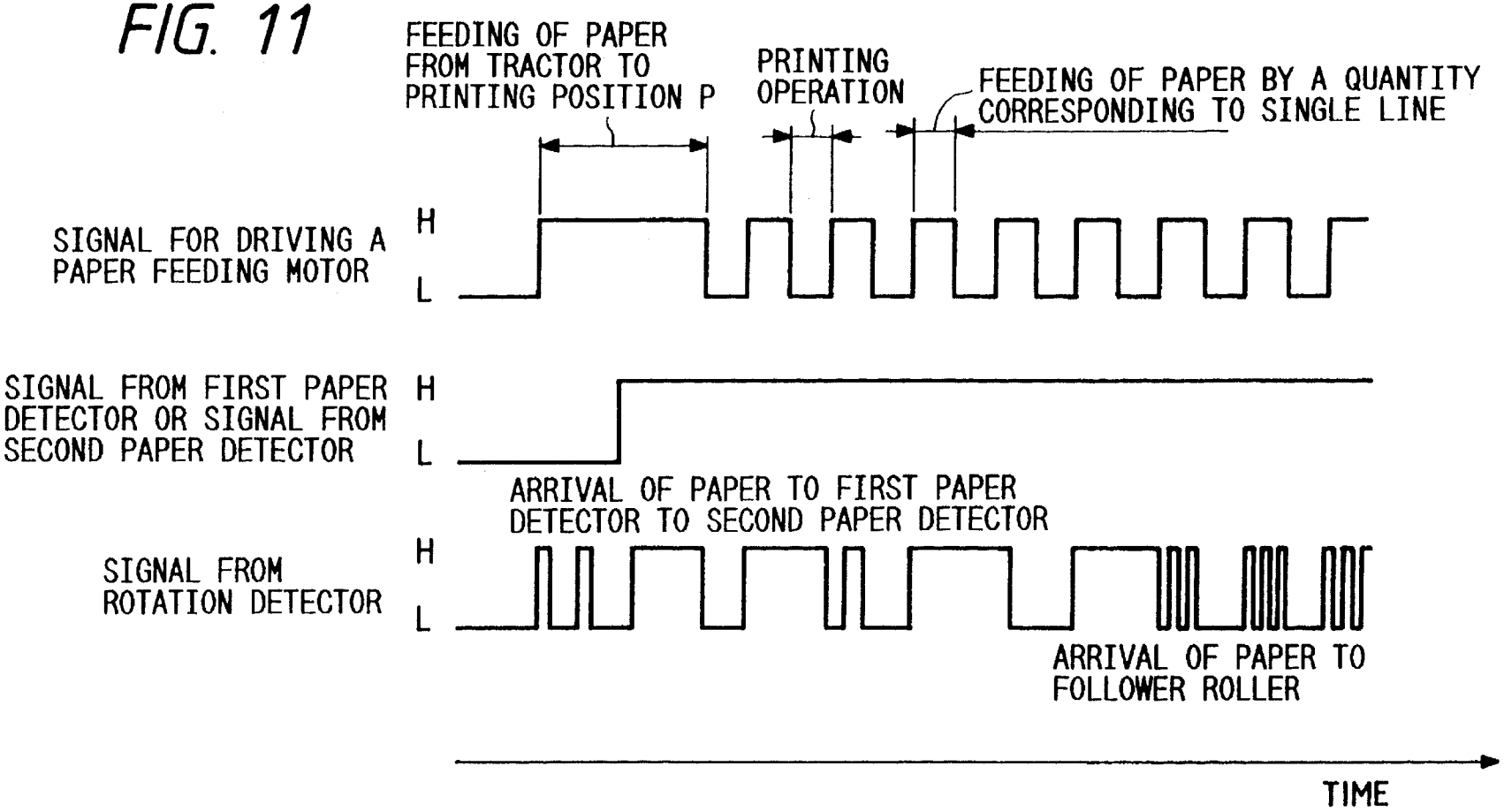
FIG. 11
SIGNAL FOR DRIVING A PAPER FEEDING MOTOR
H
L
SIGNAL FROM FIRST PAPER DETECTOR OR SIGNAL FROM SECOND PAPER DETECTOR
H
L
SIGNAL FROM ROTATION DETECTOR
H
L
FEEDING OF PAPER FROM TRACTOR TO PRINTING POSITION P
PRINTING OPERATION
FEEDING OF PAPER BY A QUANTITY CORRESPONDING TO SINGLE LINE
ARRIVAL OF PAPER TO FIRST PAPER DETECTOR TO SECOND PAPER DETECTOR
ARRIVAL OF PAPER TO FOLLOWER ROLLER
TIME

PRINTING APPARATUS

BACKGROUND OF THE INVENTION

The present invention relates generally to a printing apparatus. More particularly, the present invention relates to a printing apparatus having a technical concept employed therefor for detecting a malfunction that the printing apparatus is clogged with part of a band-shaped copying paper for which a recording operation can be performed.

A conventional printing apparatus of the type including detecting means for detecting a malfunction that the printing apparatus is clogged with a fraction of printing paper is hitherto known as disclosed in an Unexamined Japanese Patent Publication (Kokai) No. Sho. 51-78245. The detecting means disclosed in the official gazette of the prior invention will be described below with reference to FIG. 13.

In the drawing, reference numeral 8 designates a printing medium such as a sheet of printing paper or the like. The printing medium 8 is conveyed further while it is held between a plurality of driving rollers 11 and a plurality of clamping rollers 10*a* in the clamped state. The contact rollers 10*a* are normally biased toward the driving rollers 11 so that they are followably rotated by the printing medium 8 while they are brought in contact with the printing medium 8. A circular rotary plate 10*b* is fixedly secured to the right-hand end of a shaft for the contact rollers 10*a* such that it is rotated together with the contact rollers 10*a*. The circular rotary plate 10*b* serves as an encoder including two magnets 23 along the outer periphery thereof. With this construction, a conveying speed of the printing medium 8 is detected in the form of an electrical signal as a lead switch 21 is turned on or off by the magnets 23.

The conventional printing apparatus is equipped with two paper speed detecting mechanism each constructed in the above-described manner along a paper conveyance path in order to detect a malfunction that the printing apparatus is clogged with a part of the recording medium 8 based on the difference arising between the conveying speed of the recording medium 8 detected by the first paper speed detecting mechanism and the conveying speed of the same detected by the second paper speed detecting mechanism.

According to the aforementioned technical concept, since the contact rollers 10*a* and the circular rotary plate 10*b* are rotated by bringing the contact rollers 10*a* in contact with the printing medium 8, a certain magnitude of rotational load appearing attributable to the arrangement of the contact rollers 10*a*, the circular rotary plate 10*b* and the shaft extending through the contact rollers 10*a* and the circular rotary plate 10*b* is applied to the contact surface of the printing medium 8. This rotational load functions as a shearing power effective in the conveying direction of the recording medium 8.

In the case that the recording medium 8 is prepared in the form of a band-shaped copying paper having plural sheets of papers laminated one above another, positional offsetting is unavoidably caused between the paper coming in contact with the driving rollers 11 and the paper coming in contact with the contact rollers 10*a*. As a result of the foregoing positional offsetting, there arises a problem that the printed positions on the respective papers laminated in that way are slightly deviated away from each other.

In addition, as shown in FIG. 14, since a folded part or a glueing part 8*a* on the band-shaped copying paper 8 collides against the contact rollers 10*a* as the driving rollers 11 are rotated, the rotational load to be applied to the band-shaped copying paper 8 from the contact rollers 10*a* increases. Due to the increased rotational load, there arises another problem that slippage occurs between the driving rollers 11 and the band-shaped copying paper 8, resulting in the driving torque given by the driving rollers 11 failing to be transmitted to the band-shaped copying paper 8. This leads to the result that the printing apparatus is undesirably clogged with a part of the band-shaped copying paper 8. In other words, the detecting mechanism for detecting a malfunction of paper clogging disadvantageously serves to induce a malfunction that the printing apparatus is clogged with a fraction of paper.

SUMMARY OF THE INVENTION

The present invention has been made in consideration of the aforementioned background and its object resides in providing a printing apparatus capable of performing a printing operation using a band-shaped copying paper wherein there do not arise malfunctions that printed positions on plural sheets of papers laminated one above another are deviated away from each other and the printing apparatus is clogged with a fraction of paper attributable to the presence of folded parts or glueing parts on the band-shaped copying paper but the malfunction of paper clogging can exactly be detected with the printing apparatus.

To accomplish the above object, according to a first aspect of the present invention, there is provided a printing apparatus as defined in claim 1 of the claim clause, wherein the printing apparatus is characterized in that it comprises a driving roller for conveying a printing medium, a driving roller shaft for drivably supporting the driving roller, a follower roller rotatably supported on the driving roller shaft, the follower roller being followably rotated by the printing medium when it comes in contact with the printing medium, and rotation detecting means for detecting the rotation of the follower roller.

In addition, according to a second aspect of the present invention, there is provided a printing apparatus as defined in claim 2 of the claim clause, wherein the printing apparatus is characterized in that it comprises a pair of driving rollers for conveying a printing medium, a pair of driving roller shafts for drivably supporting the pair of driving rollers, a follower roller rotatably supported on one of the pair of driving roller shafts, the follower roller being followably rotated by the printing medium when it comes in contact with the printing medium, and rotation detecting means for detecting the rotation of the follower roller.

Additionally, according to a third aspect of the present invention, there is provided a printing apparatus as defined in claim 3 of the claim clause, wherein the printing apparatus is characterized in that it comprises a driving roller for conveying a printing medium, a paper guide disposed opposite to the driving roller in the spaced relationship relative to the driving roller with a certain wide gap enough to allow the printing medium prepared in the form of a band-shaped copying paper to smoothly pass therethrough, the paper guide serving to allow the printing medium to be normally biased toward the driving roller by utilizing the elasticity of the printing medium, a driving roller shaft for drivably supporting the driving roller, a follower roller rotatably supported on the driving roller shaft, the follower roller being followably rotated by the printing medium when it comes in contact with the printing medium, and rotation detecting means for detecting the rotation of the follower roller.

Further, according to a fourth aspect of the present invention, there is provided a printing apparatus as defined in claim 4 of the claim clause, wherein the printing apparatus is characterized in that it comprises a driving roller for conveying a printing medium, an auxiliary plate disposed on the upstream side as seen in the opposite direction to the printing medium conveying direction from a contact position where the printing medium comes in contact with the driving roller while defining an acute angle between the auxiliary plate and the printing medium, the auxiliary plate serving to normally bias the printing medium toward the driving roller, a driving roller shaft for drivably supporting the driving roller, a follower roller rotatably supported on the driving roller shaft, the follower roller being followably rotated by the printing medium when it comes in contact with the driving medium, and rotation detecting means for detecting the rotation of the follower roller.

In connection with the printing apparatus as defined in any one of claims 1, 2, 3 and 4 of the claim clause, the printing apparatus as defined in claim 5 of the claim clause is characterized in that a malfunction of paper clogging is detected by the rotation detecting means by comparing the signal detected by the rotation detecting means with the driving signal outputted to a driving motor for conveying the printing medium with the driving motor.

In addition, in connection with the printing apparatus as defined in anyone of claims 1, 2, 3 and 4 of the claim clause, the printing apparatus as defined in claim 6 of the claim clause is characterized in that the follower roller includes a detecting roller rotatably mounted on the driving roller shaft so as to be rotated when the driving roller comes in contact with the printing medium and a magnet adapted to be rotated together with the detecting roller and that the magnet is prepared in the form of a ring-shaped magnet including a plurality of magnet segments alternately magnetized such that adjacent segments exhibit different magnetic poles with a radially extending boundary line as a boundary therebetween.

Additionally, in connection with the printing apparatus as defined in claim 6 of the claim clause, the printing apparatus as defined in claim 7 of the claim clause is characterized in that the rotation detecting means is constructed by a detector having a Hall element employed therefor for detecting the variation of a magnetic field generated by the magnet.

Further, in connection with the printing apparatus as defined in any one of claims 1, 2, 3 and 4 of the claim clause, the printing apparatus as defined in claim 8 of the claim clause is characterized in that the detector is disposed at the position located at the side of the magnet.

Furthermore, in connection with the printing apparatus as defined in any one of claims 1, 2, 3 and 4 of the claim clause, the printing apparatus as defined in claim 9 of the claim clause is characterized in that the follower roller includes a sleeve rotatably fitted on the driving roller shaft and having flange portions at the opposite ends thereof, a ring-shaped magnet disposed between the flange portions of the sleeve and including a plurality of magnet segments alternately magnetized such that adjacent magnet segments exhibit different magnetic poles with a radially extending boundary line as a boundary therebetween and a detecting roller made of a rubber and adapted to come in contact with the printing medium, that the sleeve is press-fitted through the ring-shaped magnet and the detecting roller between the flange portions thereof, and that the sleeve, the magnet and the detecting roller are integrated with each other to build an integral structure by the pressure induced by the elasticity of the detecting roller made of a rubber so as to allow the integral structure composed of the sleeve, the magnet and the detecting roller to be rotated.

With the printing apparatus as defined in claim 1 of the claim clause, the printing medium is conveyed by the driving roller which is drivably supported by the driving roller shaft. Since the follower roller is rotatably mounted on the driving roller shaft, as the printing medium is conveyed by rotationally driving the driving roller, the follower roller is brought in contact with the printing medium, causing the follower roller to be followably rotated by the printing medium. The rotation of the follower roller is detected by the rotation detecting means.

Specifically, with the printing apparatus constructed in the above-described manner, since the follower roller serving to detect the conveyance of the printing medium is rotatably mounted on the driving roller shaft, the conveyance of the printing medium can be detected without any necessity for disposing a plurality of contact rollers 10*a* as required by the conventional printing apparatus (see FIG. 13 and FIG. 14) wherein the contact rollers 10*a* are brought in contact with a plane which is not positionally coincident with the surface along which the printing medium comes in contact with the driving roller.

Accordingly, in the case that the printing medium is prepared in the form of a band-shaped copying paper having plural sheets of papers laminated one above another, there do not arise malfunctions that printed positions on the papers are deviated away from each other and the printing apparatus is clogged with a fraction of papers attributable to the presence of the contact rollers 10*a*.

With the printing apparatus as defined claim 2 of the claim clause, the printing medium is conveyed by a pair of driving rollers which are supported by a pair of driving roller shafts. Since the follower roller is rotatably mounted on one of the pair of driving roller shafts, as the printing medium is conveyed by the pair of driving rollers, the follower roller comes in contact with the printing medium, causing the follower roller to be followably rotated by the printing medium. The rotation of the follower roller is detected by the rotation detecting means.

Specifically, also with the printing apparatus constructed in the above-described manner, since the follower roller serving to detect the conveyance of the printing paper is rotatably mounted on one of the pair of driving roller shafts, the conveyance of the printing medium can be detected without any necessity for disposing a plurality of contact rollers 10*a* as required by the conventional printing apparatus (see FIG. 13 and FIG. 14) wherein the contact rollers 10*a* are brought in contact with a plane which is not positionally coincident with the surface along which the printing medium comes in contact with the driving roller.

In addition, with the printing apparatus constructed in that way, since the printing medium is conveyed by the pair of driving rollers, the printing paper can very reliably be conveyed also in the case that the printing medium is prepared in the form of a band-shaped copying paper having plural sheets of papers laminated one above another.

Accordingly, in the case that the printing medium is prepared in the form of a band-shaped copying paper having plural sheets of papers laminated one above another, there do not arise malfunctions that printed positions on the papers are deviated away from each other and the printing apparatus is clogged with a fraction of paper attributable to the presence of the contact rollers 10*a*.

In other words, with the printing apparatus constructed in that way, since the follower roller serving to detect the conveyance of the printing medium is rotatably mounted on one of the driving roller shafts, it is possible to mount a driving roller on the driving roller shaft in place of the contact rollers 10*a* employed for the conventional printing medium, whereby the printing medium can very reliably be conveyed also in the case that it is prepared in the form of a band-shaped copying paper having plural sheets of papers laminated one above another.

With the printing apparatus as defined in claim 3 of the claim clause, since the printing medium is normally biased toward the driving roller by the action of elasticity o the printing medium itself in cooperation with the paper guide disposed opposite to the driving roller, the printing medium is reliably conveyed by the driving roller. In addition, since the follower roller is rotatably mounted on the driving roller shaft, as the printing medium is conveyed by the driving roller, the follower roller comes in contact with the printing medium, causing the follower roller to be followably rotated by the printing medium. At this time, the rotation of the follower roller is detected by the rotation detecting means.

Specifically, also with the printing apparatus constructed in that way, since the follower roller serving to detect the conveyance of the printing medium is rotatably mounted on the driving roller shaft, the conveyance of the printing medium can be detected without any necessity for disposing a plurality of contact rollers 10*a* as required by the conventional printing apparatus (see FIG. 13 and FIG. 14) wherein the contact rollers 10*a* come in contact with a plane which is not positionally coincident with the surface along which the printing medium comes in contact with the driving roller.

In addition, since the paper guide is disposed in the spaced relationship relative to the driving roller while maintaining a certain wide gap enough to allow the printing medium to smoothly pass therethrough, the printing medium is reliably conveyed also in the case that it is prepared in the form of a band-shaped copying paper having plural sheets of papers laminated one above another. At this time, there do not arise malfunctions that printed positions on the plural papers are deviated away from each other and the printing apparatus is clogged with a fraction of paper.

With the printing apparatus as defined in claim 4 of the claim clause, since the printing medium is normally biased toward the driving roller by the auxiliary plate, it is likewise reliably conveyed by the driving roller. In addition, since the follower roller is rotatably mounted on the driving roller shaft, as the printing medium is conveyed by the driving roller, the follower roller comes in contact with the printing medium, causing the follower roller to be followably rotated by the printing medium. At this time, the rotation of the follower roller is detected by the rotation detecting means.

Specifically, also with the printing apparatus constructed in the above-described manner, since the follower roller serving to detect the conveyance of the printing medium is rotatably mounted on the driving roller shaft, the conveyance of the printing medium can be detected without any necessity for disposing a plurality of contact rollers 10*a* required by the conventional printing apparatus (see FIG. 13 and FIG. 14).

Since the auxiliary plate is arranged for the printing medium coming in contact with the driving roller while defining an acute angle on the upstream side as seen in the opposite direction to the conveying direction of the printing medium from the contact position where the printing medium comes in contact with the driving roller, the printing medium is reliably conveyed without an occurrence of interference with folded parts or glueing parts on the printing medium. Thus, there do not arise malfunctions that printed positions on the plural papers are deviated away from each other and the printing apparatus is clogged with a fraction of paper.

In connection with the printing apparatus as defined in any one of claims 1, 2, 3 and 4 of the claim clause, with the printing apparatus as defined in claim 5 of the claim clause, since a malfunction of paper clogging is detected by comparing the signal detected by the rotation detecting means with the driving signal outputted to the driving motor for conveying the printing medium, an occurrence of the malfunction of paper clogging can reliably be detected with the printing apparatus.

In addition, in connection with the printing apparatus as defined in any one of claims 1, 2, 3 and 4 of the claim clause, with the printing apparatus as defined in claim 6 of the claim clause, the follower roller includes a detecting roller rotatably mounted on the driving roller shaft so as to be rotated when the driving roller comes in contact with the printing medium and a magnet adapted to be rotated together with the detecting roller, and moreover, the magnet is prepared in the form of a ring-shaped magnet including a plurality of magnet segments alternately magnetized such that adjacent magnet segments exhibit different magnetic poles with a radially extending boundary line as a boundary therebetween. Thus, the rotation of the follower roller, i.e., the conveyance of the printing medium can be detected by detecting the variation of the magnetic field.

Since the magnet is constructed in the ring-shaped configuration as mentioned above, an intensity of contact power required for rotating the follower roller when it comes in contact with the printing medium is uniformrized, resulting in smooth rotation of the follower roller being assured with the printing apparatus.

In connection with the printing apparatus as defined in claim 6 of the claim clause, with the printing apparatus as defined in claim 7 of the claim clause, since the rotation detecting means is constructed by using a Hall element for detecting the variation of a magnetic field generated by the magnet, the variation of the magnetic field can reliably be detected with the printing apparatus including the rotation detecting means in that way.

In addition, in connection with the printing apparatus as defined in claim 7, with the printing apparatus as defined in claim 8 of the claim clause, since the detector is disposed at the position located at the side of the magnet, it is possible to effectively utilize the space located on the follower roller side in the printing apparatus.

Additionally, in connection with the printing apparatus as defined in any one of claims 1, 2, 3 and 4 of the claim clause, with the printing apparatus as defined in claim 9 of the claim clause, the follower roller includes a sleeve rotatably fitted onto the driving roller shaft and having flange portions at the opposite ends thereof, a ring-shaped magnet disposed between the flange portions of the sleeve and including a plurality of magnet segments alternately magnetized such adjacent magnet segments exhibit different magnetic poles with a radially extending boundary line as a boundary therebetween and a detecting roller made of a rubber and adapted to come in contact with the printing medium, and the sleeve is press-fitted through the ring-shaped magnet and the detecting roller between the flange portions thereof. In addition, the sleeve, the ring-shaped magnet and the detecting roller are integrated with each other to build an integral structure by the pressure induced by the elasticity of the detecting roller made of a rubber so as to allow the integrated structure composed of the sleeve, the ring-shaped magnet and the detecting roller to be rotated by the printing medium. Thus, there does not arise a necessity for preparing another member for integrating the foregoing three members with each other. Consequently, an assembling operation to be performed for the follower roller can be simplified.

BRIEF DESCRIPTION OF THE DRAWINGS

FIG. 6 is a flowchart applicable to the printing apparatus constructed according to the first embodiment of the present invention;

FIG. 7 is a timing chart employable for the printing apparatus constructed according to the first embodiment of the present invention;

FIG. 11 is a timing chart employable for the printing apparatus constructed according to the second embodiment of the present invention;

DESCRIPTION OF THE PREFERRED EMBODIMENTS

The present invention will now be described in detail hereinafter with reference to the accompanying drawings which illustrate a preferred embodiments thereof.

<First Embodiment>

Figure 1:
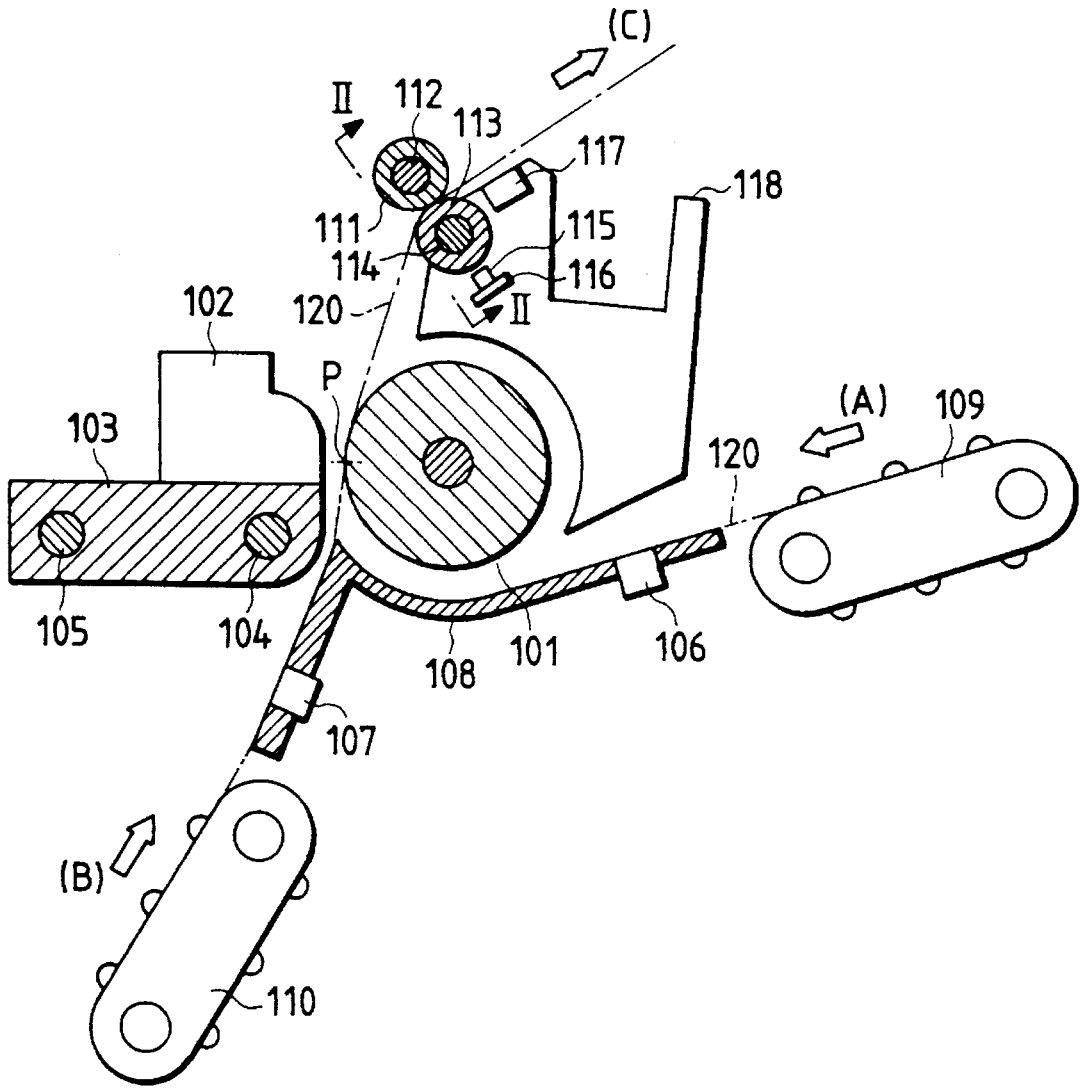
FIG. 1 is a sectional view of a printing apparatus constructed according to a first embodiment of the present invention, particularly showing essential components constituting the printing apparatus.

FIG. 1 is a sectional side view of a printing apparatus constructed according to a first embodiment of the present invention, particularly showing essential components constituting the printing apparatus.

As shown in the drawing, the printing apparatus includes a platen 101 and an impact dot type printing head 102 disposed at the position located opposite to the platen 101. The printing head 102 and the platen 101 are arranged such that a small gap is formed therebetween so as to enable a printing medium 120 to be conveyed through the foregoing gap. The printing medium 102 is typically exemplified by a band-shaped paper. With the printing apparatus constructed to the first embodiment of the present invention, a printing operation is performed for a band-shaped copying paper having plural sheets of papers laminated one above another, and the foregoing gap is determined such that the band-shaped copying paper can pass therethrough.

Incidentally, a printing position where each printing operation is performed with the printing apparatus is represented by reference character P in the drawing.

The printing head 102 is immovably mounted on a carriage 103 which in turn is supported by guide shafts 104 and 105 extending in parallel with each other. The guide shafts 104 and 105 are supported by the opposite side frames (not shown) of the printing apparatus.

A paper path (A) and a paper path (B) are arranged upstream of the printing position P as seen in the opposite direction to the direction of conveyance of the printing medium 120.

A first paper detector 106 is disposed on the paper path (A) at the intermediate position located between the printing position P and a first tractor 109. In addition, a second paper detector 107 is disposed on the paper path (B) at the intermediate position located between the printing position P and a second tractor 110.

A paper guiding plate 108 is designed in such a manner that the printing medium 120 can smoothly be conveyed from the first tractor 109 or the second tractor 110 until it reaches the printing position P.

Figure 2:
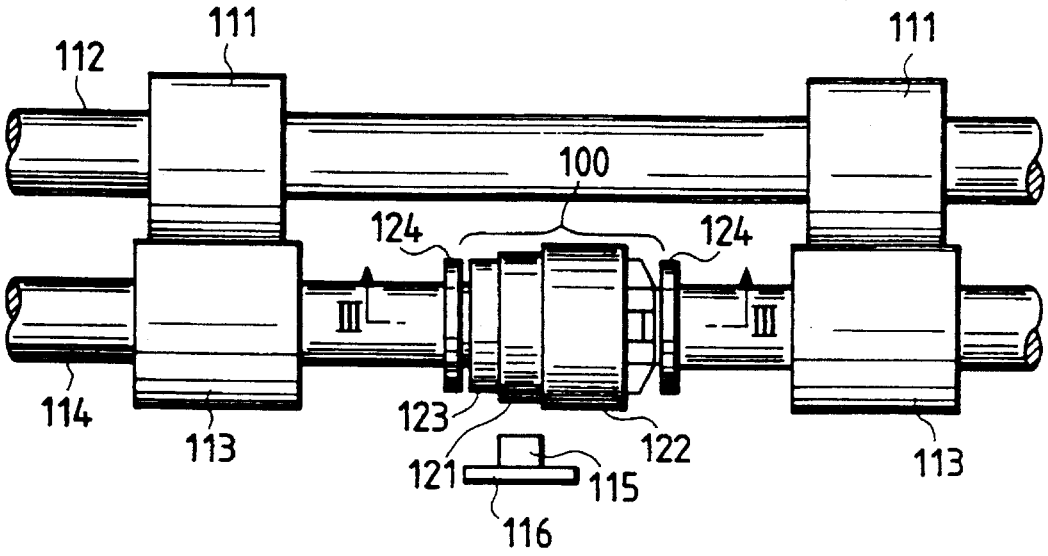
FIG. 2 is a fragmentary illustrative view of the printing apparatus as seen in II arrow-marked direction in FIG. 1.

Although only one or two opposing pair of driving rollers are shown in FIG. 1 and FIG. 2 for the convenience of illustration, six opposing pairs of driving rollers, i.e., first driving rollers 113 and second driving rollers 111 are practically arranged downstream of the printing position P on the conveyance path for the printing medium 120 in the substantially equally-spaced relationship in the vertical direction as seen in FIG. 1. However, for the purpose of simplification, description will be made below with respect to the case that two pairs of driving rollers are arranged for the printing apparatus.

The first driving rollers 113 are fixedly mounted on a first driving roller shaft 114 which in turn is supported by a platen cover 118.

The second driving rollers 111 are fixedly mounted on a second driving roller shaft 112 which is likewise supported by the platen cover 118.

Incidentally, the first driving roller shaft 114 and the second driving roller shaft 112 may be supported by the opposite side frames o the printing apparatus.

The first driving roller shaft 114 and the second driving shaft 112 are driven in synchronization with the platen 101, the first tractor 109 and the second tractor 110 by a driving motor (serving as a paper feeding motor) via a train of gears (not shown) in order to convey the printing medium 120 further. A third paper detector 117 is disposed downstream of the printing position P on the conveyance path for the printing medium 120, i.e., downstream of the positions assumed by the first driving rollers 111 and the second driving rollers 111.

Figure 3:
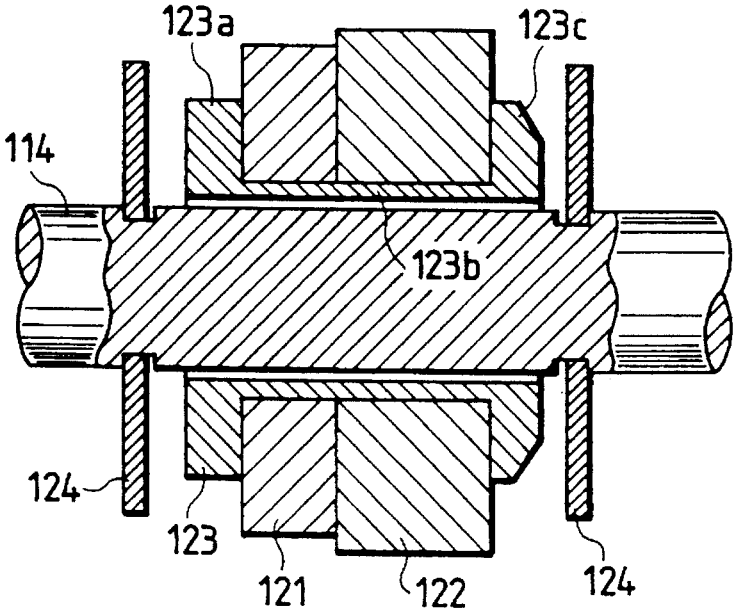
FIG. 3 is a fragmentary enlarged sectional view of the printing apparatus taken along line III—III in FIG. 2.

FIG. 2 is a fragmentary enlarged front view of the printing apparatus as seen in the II arrow-marked direction in FIG. 1, and FIG. 3 is an enlarged sectional view of the printing apparatus taken along line III—III in FIG. 2.

As shown in the drawings, the first driving rollers 113 and the second driving rollers 111 are arranged in the opposing relationship with the printing medium 120 held therebetween in the clamped state. A follower roller 100 is disposed on the first driving roller shaft 114 at the intermediate position located between both the first driving rollers 113.

The follower roller 100 is composed of a sleeve 123, a ring-shaped magnet 121 and a detecting roller 122 molded of a rubber or the like. The follower roller 100 is rotatably supported on the first driving roller shaft 114, and displacement of the follower roller 100 in the transverse direction is restricted by stopper rings 124 disposed on the opposite sides of the follower roller 100.

A circular disc-shaped flange portion 123*a* is disposed at the left-hand end of the sleeve 123, and another flange portion 123*c* of the foregoing type is disposed at the right-hand end of the same, and both the flange portions 123*a* and 123*c* are integrated with each other via four elongated elastic members 123*b* extending from the flange portion 123*a* in parallel with each other along the outer peripheral surface of the first driving roller shaft 114. An inner diameter of the sleeve 123 is dimensioned to be slightly larger than an outer diameter of the first driving roller shaft 114, and the sleeve 123 is rotatably supported on the first driving roller shaft 114 so as to freely rotate relative to the first driving roller shaft 114.

An assembling operation is achieved for the follower roller 100 in the following manner. At the preliminary stage before the sleeve 123 is rotatably mounted on the first driving roller shaft 114, the flange portion 123*c* is inserted through the magnet 121 and the detecting roller 122 while it is inwardly squeezed in the axial direction by utilizing elastic deformation of the elastic portions 123*b*, and subsequently, it is press-fitted into the detecting roller 122 to be integrated with the flange portion 123*a* by utilizing the rubber elasticity of the detecting roller 122. With this construction, the detecting roller 122 and the magnet 121 can be rotated in synchronization with each other (i.e., in the integrated state) with the aid of both the flange portions 123*a* and 123*c*.

A frictional coefficient appearing between the detecting roller 122 and the printing medium 120 is determined to be larger than that appearing between the sleeve 123 and the first driving roller shaft 114. Thus, when the detecting roller 122 comes in contact with the printing medium 120, the follower roller 100 is followably rotated by the printing medium 120.

Since the follower roller 100 and the first driving rollers 113 are arranged in the coaxial relationship, both the rollers 100 and 113 come in contact with the printing medium 120 on a common plane. Therefore, in contrast with the conventional printing apparatus, any shearing force is not generated on the printing medium 120 in the conveying direction also in the case that the printing medium 120 is prepared in the form of a band-shaped copying paper having plural sheets of papers laminated one above another. Thus, there does not arise a malfunction that printed positions on the plural sheets of papers are deviated away from each other.

The ring-shaped magnet 21 is magnetized such that the magnetic field generated thereby varies along the outer peripheral surface of the magnet 21. Specifically, as shown in FIG. 4, a plurality of magnet segments are magnetized such that adjacent magnet segments exhibit different magnetic poles with a radially extending boundary line as a boundary therebetween, whereby a plurality of annularly arranged magnet segments are alternately magnetized to alternately exhibits S-poles and N-poles.

A rotation detector 115 having a Hall element employed therefor is disposed at the position located opposite to the outer peripheral surface of the magnet 121 magnetized in the above-described manner. The rotation detector 115 is fixedly secured to the platen cover 118 via a base plate 116 (see FIG. 1).

The rotation detector 115 serves to detect rotation of the magnet 121 (i.e., rotation of the follower roller 100) as the magnetic field generated in the vicinity of the outer peripheral surface of the magnet 121 varies.

Figure 4:
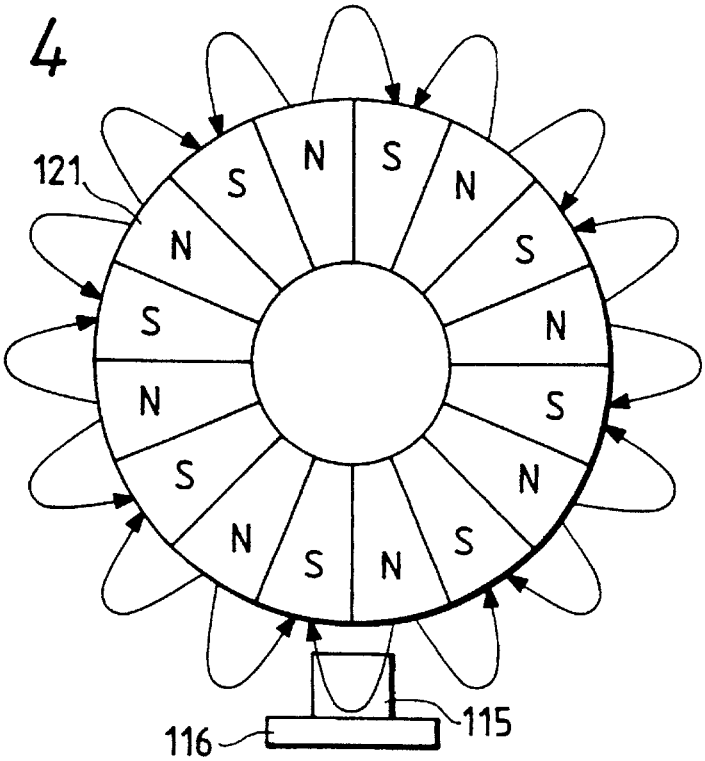
FIG. 4 is an enlarged side view of a magnet for the printing apparatus, particularly showing a magnetizing structure employable for the printing apparatus.
Figure 5:
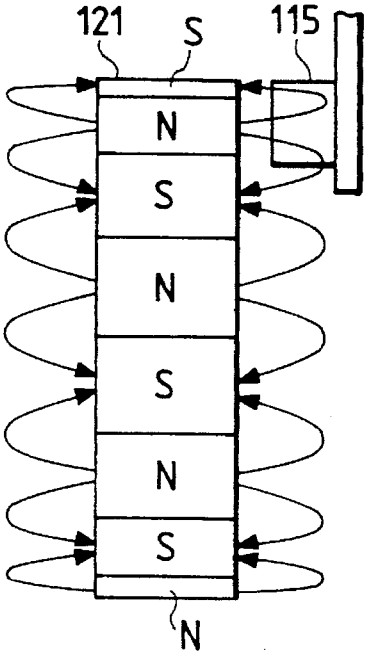
FIG. 5 is an enlarged front view of another magnet for the printing apparatus, particularly showing a magnetizing structure employable for the printing apparatus

In the case shown in FIG. 4, the rotation detector 115 is disposed while orienting in the radial direction of the magnet 121. Alternatively, as shown in FIG. 5, it may be disposed on the right-hand side of the magnet 121. Also in this case that the rotation detector 115 is disposed on the right-hand side in that way, since a magnetic flux recirculatively extends in the sideward direction in the same manner as the case shown in FIG. 4, the rotation of the magnet 121 can be detected by the rotation sensor 115.

Since it is merely required that the rotation detector 115 detects the rotation of the follower roller 100, an optical type encoder may be employed in place of a combination of the rotation detector 115 with the magnet 121.

Next, a mode of operation of the printing apparatus constructed in the aforementioned manner will be described below with reference to a flowchart shown in FIG. 6.

In the beginning, the printing apparatus is held in the standby state that it can start a printing operation in response to a printing operation command signal.

(i) In Step ST1, the printing operation start command signal is inputted into a controller (not shown) arranged for the printing apparatus. After the printing apparatus starts its printing operation, the program goes to Step ST2 or Step ST3 in which the controller determines via the first paper detector 106 or the second paper detector 107 that a sheet of recording paper is present. When the controller determines in Step ST4 via the third paper detector 117 that a sheet of recording paper is present, the program goes to Step ST5 in which the controller is brought in a paper clogging detecting mode.

(ii) While the printing apparatus is held in the paper clogging detecting mode, the program goes to Step ST6 in which the controller determines by comparing the rotation detecting signal outputted from the rotation sensor 115 with the driving signal outputted to a paper feeding motor (not shown) whether a malfunction of paper clogging occurs or not. At this time, in the case that the controller determines based on the deviation from a predetermined corresponding relationship between the rotation detecting signal and the motor driving signal that a malfunction of paper clogging occurs with the printing apparatus, the program goes to Step ST7 in which the printing apparatus stops its printing operation, resulting in a printing operation failing to be executed for a next line, subsequently, the program goes to Step ST8 in which a paper clogging message is outputted from the controller. On the contrary, in the case that the controller determines based on the coincidence with the predetermined corresponding relationship therebetween that a malfunction of paper clogging does not occur with the printing apparatus, the program goes to Step ST9 in which the printing apparatus executes a printing operation. On completion of the printing operation, the program returns to Step ST1 in which the printing apparatus is held in the standby state until a next printing operation command signal is inputted into the controller.

(iii) In the case that the controller determines in Step ST2 or Step ST3 via the first paper detector 106 or the second paper detector 107 that a sheet of printing paper is present but it determines in Step ST4 via the third paper detector 117 that a sheet of printing paper is absence, the program goes to Step ST10 in which the controller is brought in an initial printing mode. While the foregoing state is maintained, a user puts a recording medium 120, i.e., a sheet of recording paper on the first tractor 109 or the second tractor 110, and thereafter, he depresses a paper feeding button, causing the printing medium 120 to be delivered to the predetermined printing position P. At this time, the printing apparatus assumes the state that the printing medium 122 does not reach the detecting roller 122 of the follower roller 100. The operative state of the printing apparatus at this time is called an initial printing mode (Step ST10).

While the initial printing mode is maintained in Step ST10, a printing operation is achieved by a quantity of several lines but during the printing operation, the controller does not detect a malfunction of paper clogging.

Thereafter, the program goes to Step ST11 in which the controller is brought in a paper clogging detecting mode, and subsequently, the controller detects in Step ST12 whether a malfunction of paper clogging occurs with the printing apparatus or not. Specifically, the controller counts the number of driving signals outputted to the paper feeding motor for a period of time corresponding to the length of the paper conveyance path extending from the first paper detector 106 or the second paper detector 107 to the third paper detector 117. When it is found that the third paper detector 117 does not detect the printing medium 120 after completion of the initial printing mode, the controller determines that a malfunction of paper clogging occurs with the printing apparatus.

In the case that the controller determines in Step ST12 that a malfunction of paper clogging occurs with the printing apparatus, the program goes to Step ST13 in which the printing apparatus stops its printing operation, resulting in any printing operation failing to be executed with the printing apparatus, and subsequently, the program goes to Step ST14 in which the controller outputs a paper clogging message.

In the case that the controller determines in Step ST12 that any malfunction of paper clogging does not occur with the printing apparatus, the program goes to Step ST9 in which a printing operation is executed in response to a printing operation command signal, and subsequently, on completion of the printing operation, the program returns to Step ST1 in which the printing apparatus is held in the standby state until a next printing operation command signal is inputted into the controller.

(iv) In the case that the controller determines in Step ST2 and Step ST3 via the first paper detector 106 and the second paper detector 107 that a sheet of printing paper is absent, the program goes to Step ST15 in which the controller determines whether or not the terminal end of a sheet of printing paper is detected by the first paper detector 106 or the second paper detector 107 (provided that the controller determines based on the result derived from the preceding determination that a sheet of printing paper is present, it is assumed that the controller determines that the terminal end of a sheet of printing paper is detected by the first paper detector 106 or the second paper detector 107).

In the case that the controller determines in Step ST15 that the terminal end of a sheet of printing paper is detected by the first paper detector 106 or the second paper detector 107, the controller is brought in a terminal end printing mode, causing a printing operation to be executed in Step ST16 and Step ST17 until a final line on the printing paper is printed with the printing apparatus. On completion of the printing operation, the program goes to Step ST18 in which any printing operation is not executed with the printing apparatus, and subsequently, the program goes to Step ST19 in which the controller outputs a paper absence message.

In the case that the controller determines in Step ST15 that it is not brought in the terminal end printing mode, the program goes to Step ST20 in which paper feeding is executed by a quantity of several lines corresponding to a longer distance selected from the distance measured from the first tractor 109 to the first paper detector 106 and the distance measured from the second tractor 110 to the second paper detector 107. On completion of the paper feeding, the program goes to Step ST21 in which the controller determines that a sheet of printing paper is absent when the signal outputted from the first paper detector 106 or the second paper detector 107 does not vary, and subsequently, the program goes to Step ST22 in which the controller outputs a paper absence message.

When it is found in Step ST21 that the signal outputted from the first paper detector 106 or the second paper detector 107 varies, the program returns to Step ST2.

FIG. 7 is a timing chart applicable to the printing apparatus constructed according to the first embodiment of the present invention wherein the printing apparatus is held in the operative state that a malfunction of paper clogging does not occur with the printing apparatus.

In response to a pulse signal, the paper feeding motor designed in the form of a stepping motor is rotationally driven, causing the recording medium 102 to be delivered from the first tractor 109 or the second tractor 110. When the recording medium 120 reaches the first paper detector 106 or the second paper detector 107, the signal outputted from the first paper detector 109 or the second paper detector 110 is changed from L to H. Thereafter, the recording medium 120 is delivered to the printing position P where a printing operation is executed with the printing head 102.

When the recording medium 120 passes by the follower roller 100 after several lines are printed on the recording medium 120, the signal outputted from the third detector 117 is changed from L to H.

The signal outputted from the rotation sensor 115 is kept unstable until the recording medium 120 reaches the follower roller 100 (it should be added that a point of time when the recording medium 120 reaches the follower roller 100 is represented by t1 in FIG. 7). As is apparent from the flowchart shown in FIG. 6, however, there does not arise any particular problem in spite of the fact that the foregoing signal is kept unstable until the printing medium 120 reaches the third detector 117 because it is not used for determining the operative state of the printing apparatus. As long as the printing medium 120 is properly conveyed after the recording medium 120 reaches the follower roller 100, a series of regular signals are outputted from the rotation detector 115 as regularly rotate the follower roller 100. It should be noted that the magnet 121 is magnetized such that a rotation detection signal generated in the form of one pulse or more is outputted in response to a driving signal corresponding to the feeding of the recording medium 120 by a quantity of one line.

Figure 8:
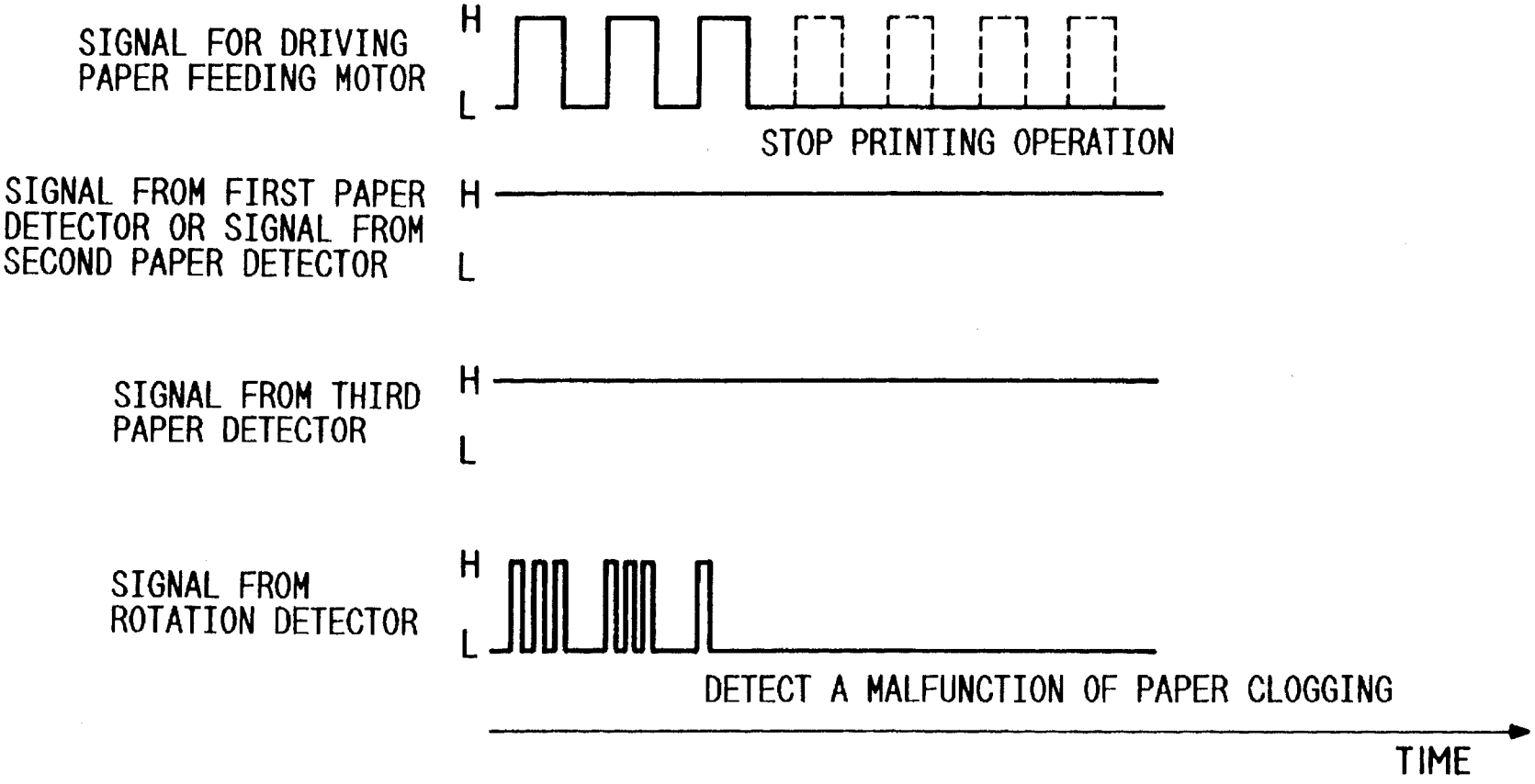
FIG. 8 is another timing chart employable for the printing apparatus constructed according to the first embodiment of the present invention.

FIG. 8 is another timing chart applicable to the printing apparatus constructed according to the first embodiment of the present invention wherein the printing apparatus is held in the operative state that a malfunction of paper clogging occurs with the printing apparatus.

This timing chart shows a series of times which are located rightward of those shown in FIG. 7.

The paper feeding motor is rotationally driven in such a manner that the printing medium is stepwise conveyed every one line.

In the shown case, the controller determines via the first paper detector 106 or the second paper detector 107 the operative state that the printing medium 120 is present, and moreover, determines via the third paper detector 117 the operative state that the printing medium 120 is present.

At this time when it is found that rotation detecting signals outputted from these paper detectors are not changed in spite of the fact that the paper feeding motor is rotationally driven, the controller determines based on the foregoing operative state that a malfunction of paper clogging occurs with the printing apparatus.

Specifically, while the printing apparatus is held in the operative state that a malfunction of paper clogging does not occurs with the printing apparatus, the recording medium 120 is conveyed by the first driving roller 113 and the second driving roller 111, and the follower roller 100 is followably rotated by the printing medium 120. At this time, when there arises a malfunction of paper clogging, slippage occurs between the printing medium 120 and a combination of the first driving roller 113 and the second driving roller 111, causing the conveyance of the recording medium 120 to be stopped. This leads to the result that the rotation of the follower roller 100 is stopped although the first driving roller 113 and the second driving roller 111 are still rotationally driven. In other words, when the controller detects based on the signals outputted from the paper detectors that the rotation of the follower roller 100 is stopped in spite of the fact that the controller determines based on the driving signal inputted into the driving motor and the signals outputted from the paper detectors that the printing medium 120 is present, the controller detects that a malfunction of paper clogging occurs with the printing apparatus.

With the printing apparatus constructed according to the first embodiment of the present invention in the above-described manner, the following advantageous effects are obtainable with the printing apparatus.

Figure 13:
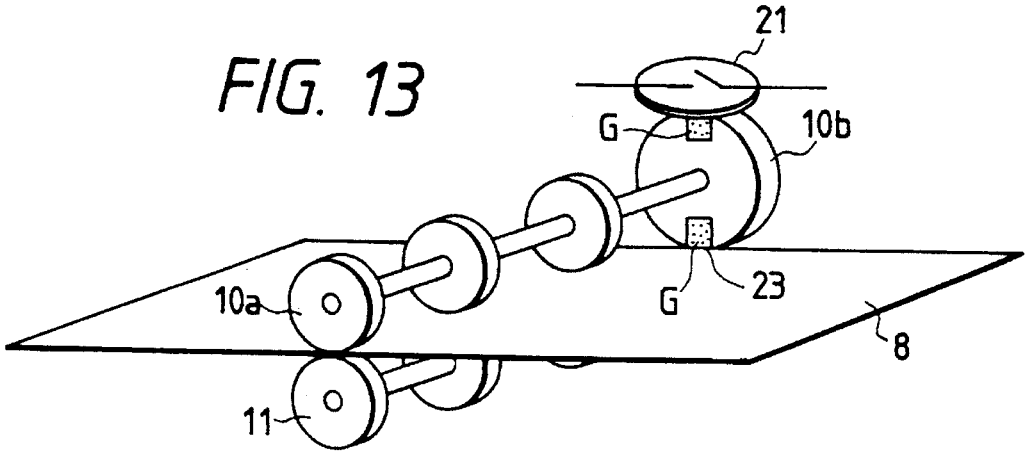
FIG. 13 is a perspective view of a conventional printing apparatus.
Figure 14:
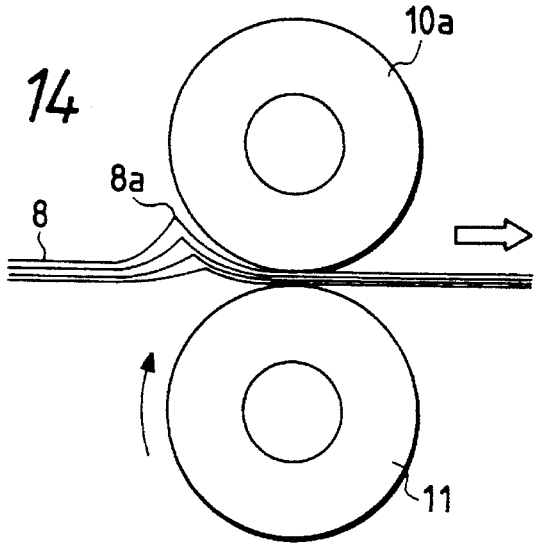
FIG. 14 is a fragmentary enlarged illustrative view of the conventional printing apparatus, particularly showing a problem arising with the conventional printing apparatus.

(a) Since the follower roller 100 for detecting the conveyance of the printing medium 120 is mounted on the driving roller shaft 114, the conveyance of the printing medium 120 can be detected without any necessity for disposing a plurality of contact rollers 10*a* as required by the conventional printing apparatus (see FIG. 13 and FIG. 14) wherein the contact rollers 10*a* come in contact with the plane which is not positionally coincident with the surface along which the printing medium comes in contact with the driving rollers.

Consequently, in the case that the printing medium 120 is prepared in the form of a band-shaped copying paper having plural sheets of papers laminated one above another, there do not arise malfunctions that printed positions on the plural sheets of papers are deviated away from each other and the printing apparatus is clogged with a fraction of paper.

(b) Since the printing medium 120 is conveyed by an opposing pair of driving rollers 111 and 113, it can very reliably be conveyed without any occurrence of a malfunction of paper clogging while reliably preventing the printed positions on the plural sheets of papers from being deviated away from each other.

(c) Since the controller detects whether the printing apparatus is clogged with a fraction of the recording medium 120 or not by comparing the signal detected by the rotation detector 115 with the driving signal outputted from the controller for rotationally driving the paper feeding motor (driving motor), it is possible to reliably detect a malfunction that the printing apparatus is clogged with a fraction of the printing medium 120.

(d) Since the follower roller 100 includes the detecting roller 122 rotatbly mounted on the driving roller shaft 114 to be rotated while coming in contact with the printing medium 120 and the magnet 121 adapted to be rotated together with the detecting roller 122, and moreover, the magnet 121 is magnetized such that adjacent magnet segments are magnetized to exhibit different magnetic poles with a radially extending boundary line as a boundary therebetween, the rotation of the follower roller 100, i.e., the conveyance of the recording medium 120 can be detected by detecting the variation of the magnetic field generated by the magnet 121.

Since the magnet 121 is constructed in the ring-shaped configuration, a magnitude of contact power required for rotating the follower roller 100 which comes in contact with the printing medium 120 is uniformrized, resulting in smooth rotation of the follower roller 100 being obtainable.

(e) Since the rotation detecting means is constructed in the form of the detector 115 having a Hall element employed therefor for detecting the variation of the magnetic field generated by the magnet 121, the variation of the magnetic field can reliably be detected by the rotation detecting means.

(f) In the case that the rotation detector 115 is disposed on one side of the magnet 121, i.e., on the side of the same at the position located opposite to the magnet 121 as shown in FIG. 5, it is possible to effectively utilize the space located on the side of the follower roller 100 in the printing apparatus.

(g) Since the follower roller 100 is rotatably mounted on the driving roller shaft 114 such that the sleeve 123, the magnet 121 and the detecting roller 122 are rotated together by the pressure derived from the elasticity of the detecting roller 122 molded of a rubber, there does not arise a necessity for disposing another member for integrating three members, i.e., the sleeve 123, the magnet 121 and the detecting roller 122 with each other. Thus, an assembling operation to be performed for the follower roller 100 can be simplified. Especially, since an assembling operation to be performed for the follower roller 100 can be achieved merely by inserting the elastic portions 123*b* axially extending from the flange portion 123*c* of the sleeve 123 through the magnet 121 and the detecting roller 122 by utilizing the elastic deformation of the elastic portion 123*b* of the flange portion 123*c*, the foregoing assembling operation can simply be performed.

As is apparent from the above description, with the printing apparatus constructed according to the first embodiment of the present invention, a malfunction of paper clogging can exactly be detected without any occurrence of malfunctions that printed positions on the plural sheets of papers are deviated away from each other and the printing apparatus is clogged with a fraction of paper attributable to the presence of folded portions and glueing portions on the printing medium 120 also in the case that a band-shaped copying paper is used as a printing medium to be printed, because the follower roller 100 is rotatably supported to freely rotate relative to the first driving roller shaft 114, the rotation detecting means is disposed for the follower roller 100, and the second driving roller 111 is arranged at the position located opposite to the first driving roller 113.

<Second Embodiment>

Figure 9:
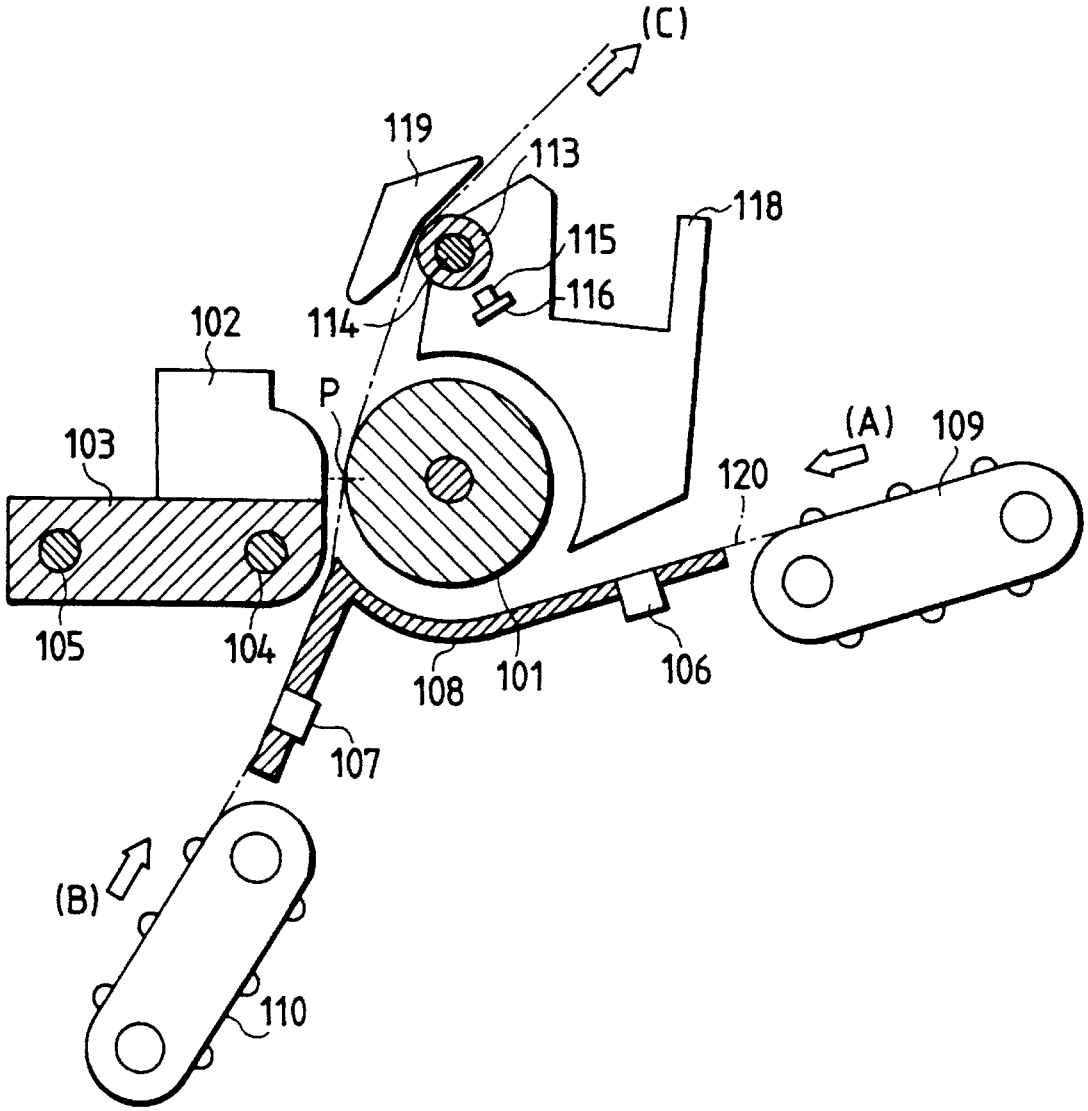
FIG. 9 is a sectional view of a printing apparatus constructed according to a second embodiment of the present invention, particularly showing essential components constituting the printing apparatus.

FIG. 9 is a sectional view of a printing apparatus constructed according to a second embodiment of the present invention, particularly showing essential components constituting the printing apparatus.

In practice, this embodiment is different from the first embodiment of the present invention only in respect of the technical concept that the third paper detector 117 in the preceding embodiment is removed from the printing apparatus, and a plurality of paper discharging guides 119 are arranged as seen in FIG. 9 (in FIG. 9 only one discharging guide 119 is depicted).

A follower roller 100 is rotatably mounted on a driving roller shaft 114 like the first embodiment. The follower roller 100 and a driving roller 113 are arranged while facing to the paper discharging guides 119. Each of the paper discharging guides 119 is designed to exhibit such a smooth contour that any shearing power effective in the conveying direction for causing printed positions position on the plural sheets of papers to deviated away from each other is not generated regardless of how a band-shaped copying paper comes in contact with the paper discharging guides 119, and moreover, each paper discharging guide 119 does not interfere with folded parts and glueing parts on the band-shaped copying paper. It should be added that a certain wide gap enough to enable the band-shaped copying paper, i.e., a printing medium 120 to smoothly pass therethrough is formed between the paper discharging guides 119 and a combination of the driving roller 113 and the follower roller 100.

The surface of each paper discharging guides 119 facing to the driving rollers 113 are slightly bent so as to allow a part of the driving roller 113 to be received in the concavely bent surface of the paper discharging guide 119. Thus, when the conveyance of printing medium 120 is properly guided by the paper discharging guides 119, the printing medium 120 comes in contact with the driving roller 113 while it is squeezed toward the driving roller 113 by the bending elasticity of itself, and thereafter, it is conveyed further by the driving roller 113.

Since the follower roller 100 is rotatably supported on the driving roller shaft 114 in the same manner as the preceding embodiment, as the printing medium 120 is conveyed by the driving roller 113, the follower roller 100 comes in contact with the printing medium 120 which in turn rotates the follower roller 100. At this time, the rotation of the follower roller 100 is detected by a rotation detector 115.

Also with the printing apparatus constructed according to the second embodiment of the present invention, since the follower roller 100 is rotatably mounted on the driving roller shaft 114 in order to detect the conveyance of the printing medium 120, the conveyance of the printing medium 120 can reliably be detected without any necessity for disposing a plurality of contact rollers 10*a* as required by the convectional printing apparatus (see FIG. 13 and FIG. 14) wherein the contact rollers 10*a* come in contact with a plane which is not positionally coincident with the surface along which the printing medium comes in contact with the driving roller.

In addition, since the paper discharging guides 119 are arranged in the spaced relationship relative to the driving roller 113 with a certain wide gap enough to allow the printing medium 120 to smoothly pass therethrough, also in the case that the printing medium 120 is prepared in the form of a band-shaped copying paper having plural sheets of papers laminated one above another, it can reliably be conveyed without any occurrence of malfunctions that recorded positions on the plural sheets of papers are slightly deviated away from each other and the printing apparatus is clogged with a fraction of paper.

Figure 10:
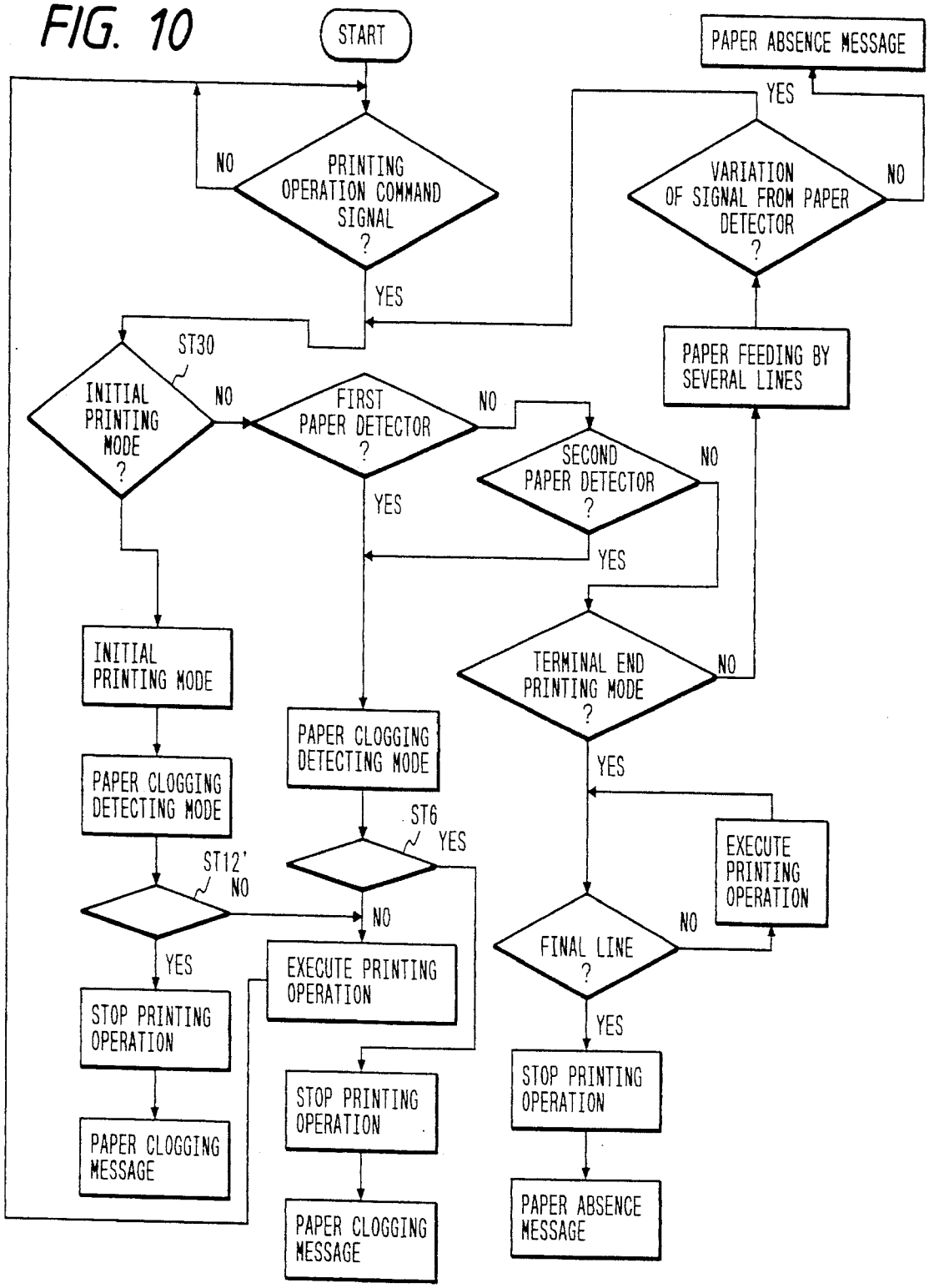
FIG. 10 is a flowchart applicable to the printing apparatus constructed according to the second embodiment of the present invention.

FIG. 10 is a flowchart which shows a series of steps to be practiced by the printing apparatus constructed according to the second embodiment of the present invention.

This flowchart is different from the flowchart shown in FIG. 6 employable for the printing apparatus constructed according to the first embodiment of the present invention only in respect of the technical concept that determination to be made by the third paper detector 117 (corresponding to Step ST4 in FIG. 6) is removed from the printing apparatus but determination to be made whether the controller is brought in an initial printing mode or not (corresponding to Step ST30 in FIG. 10) is added to the flowchart in order to determine by comparing the driving signal outputted to a paper feeding motor with the rotation detecting signal outputted from a rotation detector whether or not a malfunction of paper clogging is detected on completion of the initial printing mode (corresponding to Step ST12' in FIG. 10). The initial printing mode determination is made by depressing a paper feeding button with a user's finger.

Detection of the malfunction of paper clogging in Step ST12' starts when a user depresses the paper feeding button. When the rotation of the follower roller 100 is not detected by the rotation detector 115 after the initial printing mode is completed by counting the number of paper feeding motor driving signals outputted from the controller for a period of time that elapses from the time when the foremost end of the printing medium 120 reaches the first paper detector 106 or the second paper detector 107 till the time when it reaches the follower roller 100, the controller determines that a malfunction of paper clogging occurs with the printing apparatus.

FIG. 11 is a timing chart applicable to the printing apparatus constructed according to the second embodiment of the present invention.

This timing chart is substantially identical with the timing chart shown in FIG. 7 applicable to the printing apparatus constructed according to the first embodiment of the present invention with the exception that on completion of the initial printing mode, a malfunction of paper clogging is detected by using the rotation detecting signal outputted from the follower roller 100 operatively associated with the rotation detector 115 in place of the third paper detector 107 employable for practicing the preceding embodiment.

Also with the printing apparatus constructed according to the second embodiment of the present invention, the advantageous effects described above in the paragraphs (a), (b), (c), (d), (e), (f) and (g) with respect to the first embodiment of the present invention are unchangeably obtainable. In case that a band-shaped copying paper is used as a recording medium, a malfunction of paper clogging can exactly be detected not only without positional deviation of recorded positions on plural sheets of papers away from each other but also without any occurrence of a malfunction of paper clogging attributable to folded parts and glueing parts on the recording medium.

According to the second embodiment of the present invention, since the third paper detector 117 is not required, the printing apparatus can be produced at a reduced cost.

<Third Embodiment>

Figure 12:
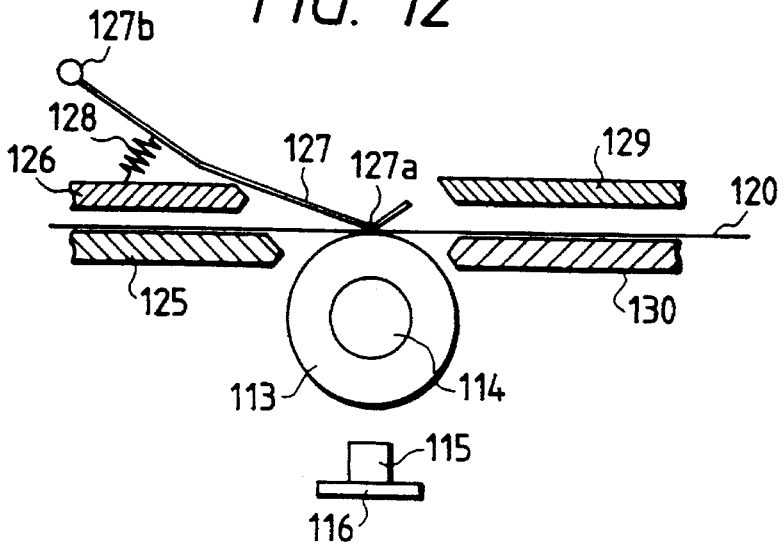
FIG. 12 is a fragmentary sectional view of a printing apparatus constructed according to a third embodiment of the present invention, particularly showing essential components constituting the printing apparats.

FIG. 12 is a fragmentary enlarged sectional view of a printing apparatus constructed according to a third embodiment of the present invention.

This embodiment is different from the second embodiment of the present invention only in respect of the technical concept that the paper discharge guides 119 in the preceding embodiment are removed from the printing apparatus, paper guide plates 125 and 126 are located intermediate driving roller 113 and platen 101. Similarly, driving roller 113 is intermediate paper guide plates 125 and 126 and guide plates 129 and 130. An auxiliary plate 127 is brought in a little pressure contact with the driving roller 113 in order to prevent a printing medium 120 from being floated up from the driving roller 113. A follower roller 100 is rotatably mounted on a driving roller shaft 114 in the same manner as each of the aforementioned embodiments of the present invention.

The auxiliary plate 127 is turnably arranged to turn about a fulcrum 127*b*, and a contact portion 127*a* of the auxiliary plate 127 is brought in pressure contact with the driving roller 113 and the follower roller 100 by the resilient force of a resilient member 128. An intensity of the resilient force of the resilient member 128 is set to be low in order to prevent malfunctions of deviation of printed dots on the band-shaped printing paper away from predetermined ones as well as interference of the contact portion 127*a* of the auxiliary plate 127 with folded parts and glueing parts on the band-shaped printing paper from occurring. In addition, the auxiliary plate 127 is arranged such that the angle defined by the auxiliary plate 127 relative to the printing medium 120 on the upstream side from the contact portion 127*a* of the auxiliary plate 127 as seen in the opposite direction to the printing medium conveying direction becomes an acute angle. Thus, there does not arise a malfunction that the contact portion 127*a* of the auxiliary plate 127 interferes with folded parts and glueing parts on the recording medium 120 when it pass by them. Since the paper guide plates 125, 126, 129 and 130 are arranged before and behind the driving roller 113, it is assured that conveyance of the printing medium 120 is exactly guided along the paper path. It should be noted that the auxiliary plate 127 itself may serve as a leaf spring without any necessity for disposing the resilient member 128 or with the resilient member 128 removed from the printing apparatus.

With the printing apparatus constructed in the above-described manner, since the printing medium 120 is normally biased toward the driving roller 113 by the auxiliary plate 127 to come in pressure contact with the same, the printing medium 120 can reliably be conveyed further by the driving roller 113. Since the follower roller 100 is rotatably mounted on a driving roller shaft 114 in the same manner as the first and second embodiments of the present invention, as the printing medium 120 is conveyed by the driving roller 113, the follower roller 100 is followably rotated while coming in contact with the printing medium 120. At this time, the rotation of the follower roller 100 is detected by a rotation detector 115.

Also with the printing apparatus constructed according to the third embodiment of the present invention, since the follower roller 100 is rotatably mounted on the driving roller shaft 114 in order to detect conveyance of the printing medium 120, the conveyance of the printing medium 120 can be detected without any necessity for disposing a plurality of contact rollers 10*a* as required by the conventional printing apparatus (see FIG. 13 and FIG. 14) wherein the contact rollers 10*a* come in contact with a plane which is not positionally coincident with the surface along which the recording medium comes in contact with the driving roller.

Since the auxiliary plate 127 is arranged at an acute angle relative to the printing medium 120 adapted to contact with the driving roller 113, also in the case that the printing medium 120 is prepared in the form of a band-shaped copying paper having plural sheets of papers laminated one above another, it can reliably be conveyed without any occurrence of a malfunction that the contact portion 127*a* of the auxiliary plate 127 interferes with folded parts or glueing parts on the recording medium 120. In addition, there do not arise malfunctions that printed positions on the plural sheets of papers are deviated away from each other and the printing apparatus is clogged with a fraction of paper.

Also with the printing apparatus constructed according to the third embodiment of the present invention, the advantageous effects as mentioned in the paragraphs (a), (b), (c), (d), (e), (f) and (g) and described above with respect to the first embodiment of the present invention are unchangeably obtainable. Also in the case that a band-shaped copying paper is used as a recording medium, there do not arise malfunctions that printed positions on the plural sheets of papers are deviated away from each other and the printing apparatus is clogged with a fraction of paper attributable to the presence of folded parts and glueing parts on the recording medium. Consequently, a malfunction of paper clogging can exactly be detected.

Also according to the third embodiment of the present invention, since the third paper detector 117 employed in the first embodiment of the present invention is not required, the printing apparatus more simply can be produced at a reduced cost.

While the present invention has been described above with respect to a few preferred embodiments thereof, it should of course be understood that the present invention should not be limited only to these embodiments but various change or modification may be made without any departure from the scope of the present invention.

For example, in each of the aforementioned embodiments, the follower roller 100 may be disposed at the position located upstream of the printing position P. In this case, the same advantageous effects as mentioned in each of the respective embodiments are obtainable by adequately changing the time when a detecting operation for detecting a malfunction of paper clogging.

As will be apparent from the above description, according to the present invention, in the case that a band-shaped copying paper having plural sheets of papers laminated one above another is used as a recording medium, there do not arise malfunctions that recorded positions on the plural sheets of papers are deviated away from each other and the printing apparatus is clogged with a fraction of paper attributable to the presence of folded parts and glueing parts on the recording medium. Consequently, a malfunction of paper clogging can exactly be detected.

What is claimed is:

1. A printing apparatus comprising:

a driving roller for conveying a printing medium;

a driving roller shaft for drivably supporting said driving roller;

a follower roller rotatably supported on said driving roller shaft, said follower roller being followably rotated by said printing medium when it comes in contact with said printing medium;

said follower roller including a sleeve rotatably fitted onto said driving roller shaft and including flange portions at the opposite ends thereof, a ring-shaped magnet disposed between said flange portions of said sleeve and including a plurality of magnet segments alternately magnetized such that adjacent magnet segments exhibit different magnetic poles with a radially extending boundary line as a boundary therebetween and a detecting roller made of a rubber and adapted to come in contact with said printing medium, that said sleeve is press-fitted through said ring-shaped magnet and said detecting roller between said flange portions thereof, and that said sleeve, said ring-shaped magnet and said detecting roller are integrated with each other to build an integral structure by the pressure induced by the elasticity of said detecting roller molded of a rubber so as to allow an assembly of said sleeve, said ring-shaped magnet and said detecting roller to be rotated; and a rotation detector for detecting the rotation of said follower roller.

2. A printing apparatus comprising:

a pair of driving rollers for conveying a printing medium;

a pair of driving roller shafts for drivably supporting said pair of driving rollers;

a follower roller rotatably supported on one of said pair of driving roller shafts, said follower roller being followably rotated when it comes in contact with said printing medium by said printing medium;

said follower roller including a sleeve rotatably fitted onto one of said pair of driving roller shafts and including flange portions at the opposite ends thereof, a ring-shaped magnet disposed between said flange portions of said sleeve and including a plurality of magnet segments alternately magnetized such that adjacent magnet segments exhibit different magnetic poles with a radially extending boundary line as a boundary therebetween and a detecting roller made of a rubber and adapted to come in contact with said printing medium, that said sleeve is press-fitted through said ring-shaped magnet and said detecting roller between said flange portions thereof, and that said sleeve, said ring-shaped magnet and said detecting roller are integrated with each other to build an integral structure by the pressure induced by the elasticity of said detecting roller molded of a rubber so as to allow an assembly of said sleeve, said ring-shaped magnet and said detecting roller to be rotated; and a rotation detector for detecting the rotation of said follower roller.

3. A printing apparatus characterized in that said printing apparatus comprises:

a first driving roller and a second driving roller for conveying a printing medium, a paper guide disposed opposite to said driving roller in the spaced relationship relative to said driving roller with a certain wide gap enough to allow said printing medium prepared in the form of a band-shaped copying paper to smoothly pass therethrough, said paper guide serving to allow said printing medium to be normally biased toward said driving roller by utilizing the elasticity of said printing medium, a driving roller shaft for drivably supporting said first and said second driving rollers, a follower roller disposed intermediate said first driving roller and said second driving roller and rotatably supported on said driving roller shaft, said follower roller being followably rotated by said printing medium when it comes in contact with said printing medium, and a rotation detector for detecting the rotation of said follower roller.

4. A printing apparatus characterized in that said printing apparatus comprises:

a first driving roller and a second driving roller for conveying a printing medium, an auxiliary plate for biasing said printing medium toward said first and second driving rollers, said auxiliary plate and said printing medium defining an acute angle when said printing medium comes in contact with said auxiliary plate, a driving roller shaft for drivably supporting said first driving roller and said second driving roller, a follower roller disposed intermediate said first and second driving rollers and rotatably supported on said driving roller shaft, said follower roller being followably rotated by said printing medium when it comes in contact with said printing medium, and a rotation detector for detecting the rotation of said follower roller.

5. The printing apparatus as claimed in claims 3 or 4, characterized in that a malfunction of paper clogging is detected by comparing the signal detected by said rotation detector with the driving signal outputted to a driving motor for conveying said printing medium with said driving motor.

6. The printing apparatus as claimed in claims 3 or 4, characterized in that said follower roller includes a detecting roller rotatably mounted on said driving roller shaft so as to be rotated when said detecting roller comes in contact with said printing medium and a magnet adapted to be rotated together with said detecting roller and that said magnet is prepared in the form of a ring-shaped magnet including a plurality of magnet segments alternately magnetized such that adjacent magnet segments exhibit different magnetic poles with a radially extending boundary line as a boundary therebetween.

7. The printing apparatus as claimed in claim 6, characterized in that said rotation detector is constructed by a detector having a Hall element employed therefor for detecting the variation of a magnetic field generated by said magnet.

8. The printing apparatus as claimed in claim 7, characterized in that said detector is disposed at the position located opposite to the side surface of said magnet.

9. The printing apparatus as claimed in claims 3 or 4, characterized in that said follower roller includes a sleeve rotatably fitted onto said driving roller shaft and including flange portions at the opposite ends thereof, a ring-shaped magnet disposed between said flange portions of said sleeve and including a plurality of magnet segments alternately magnetized such that adjacent magnet segments exhibit different magnetic poles with a radially extending boundary line as a boundary therebetween and a detecting roller made of a rubber and adapted to come in contact with said printing medium, that said sleeve is press-fitted through said ring-shaped magnet and said detecting roller between said flange portions thereof, and that said sleeve, said ring-shaped magnet and said detecting roller are integrated with each other to build an integral structure by the pressure induced by the elasticity of said detecting roller molded of a rubber so as to allow an assembly of said sleeve, said ring-shaped magnet and said detecting roller to be rotated.

* * * * *